US006772681B1

(12) United States Patent
Raio et al.

(10) Patent No.: US 6,772,681 B1
(45) Date of Patent: Aug. 10, 2004

(54) PRESS MACHINE

(75) Inventors: Steve Michael Raio, Yorba Linda, CA (US); John Boyer, Yorba Linda, CA (US)

(73) Assignee: Proprocess Corporation, Paramount, CA (US)

( * ) Notice: Subject to any disclaimer, the term of this patent is extended or adjusted under 35 U.S.C. 154(b) by 0 days.

(21) Appl. No.: 10/374,125

(22) Filed: Feb. 25, 2003

(51) Int. Cl.[7] ..... B30B 1/04
(52) U.S. Cl. ..... 100/293; 100/233; 156/580
(58) Field of Search ..... 100/233 R, 280, 100/219, 257, 265, 293 OR; 156/580 R, 583.1, 583.8

(56) References Cited

U.S. PATENT DOCUMENTS

| | | | | | |
|---|---|---|---|---|---|
| 2,644,151 | A | * | 6/1953 | Krueger | 100/319 |
| 3,450,031 | A | * | 6/1969 | Peterson | 100/326 |
| 3,979,248 | A | * | 9/1976 | Kussmaul | 15/358 |
| 3,988,981 | A | * | 11/1976 | McDonald | 100/99 |
| 5,167,750 | A | * | 12/1992 | Myers | 156/583.9 |
| 5,435,883 | A | * | 7/1995 | Myers | 156/583.9 |
| 5,474,633 | A | * | 12/1995 | Myers | 156/230 |

OTHER PUBLICATIONS

The DOUGHPRO Model DP 1100, Operating Manual, 4 pages, Proprocess Corporation, Paramount, California, USA.

The DOUGHPRO Model DP 1300, Advertisement, 2 pages, Proprocess Corporation, Paramount, California, USA.

The DOUGHPRO Model DP 1400, Advertisement, 2 pages, Proprocess Corporation, Paramount, California USA.

The DOUGHPRO Model DP 1800, Advertisement, 1 page, Proprocess Corporation, Paramount, California, USA.

The DOUGHPRO Press–In–The–Pan 6000 Series, Advertisement, 3 pages, Proprocess Corporation, Paramount, California, USA.

Bakon "Press–N–Bake" Tartlet Machine, Advertisement, 2 pages, Bakon USA Food Equipment, Mission Hills, California, USA.

High Speed Series 70, Advertisement, 1 page, Colborne Manufacturing Co., Glenview, Illinois, USA.

T–28000 Turnover Pie Machine, Advertisement, 1 page, Colborne Manufacturing Co., Glenview, Illinois, USA.

Comtec Model 1100 PZ Pizza Crust Press, Advertisement, 2 pages, Component Tech Engineering Company, Worth, Illinois, USA.

Comtec Model 2200 Pie Top and Shell Press, Advertisement, 2 pages, Component Tech Engineering Company, Worth, Illinois, USA.

* cited by examiner

*Primary Examiner*—Allen Ostrager
*Assistant Examiner*—Shelley Self
(74) *Attorney, Agent, or Firm*—Stetina Brunda Garred & Brucker

(57) ABSTRACT

A pressing device is disclosed including a housing, a lower engaged to that housing and adapted to receive products to be pressed and an upper platen engaged to the housing and manually translatable with respect to the lower platen. A handle mechanism is connected to the upper platen for translating the upper platen with respect to the lower platen. The handle mechanism includes a resilient over-center locking mechanism for translating the upper platen to a locked position proximate the lower platen, whereupon the upper platen is further translated towards the lower platen independent of manual force.

10 Claims, 4 Drawing Sheets

PRESS MACHINE

FIELD OF THE INVENTION

The present invention relates to press machines of the type that may be used for dough presses and to apply heat transfer designs to clothing or other articles.

BACKGROUND OF THE INVENTION

Hand operated press machines have long been used for a variety of different applications. In food preparation applications such presses may be used to press balls of dough into the shape of a pizza crust or other desired shapes, as may be dictated by the construction of the upper and lower platens. As the press is operated, a movable upper platen is typically brought downward towards the stationary lower platen, compressing a product there-between. The upper platen is typically coupled to a mechanism allowing the user to pull down on a handle to bring the two platens to proximate engagement. The force applied to the product is typically dictated by the downward force that is manually applied to a handle mechanism, for so long as the operator continues to apply that force.

While such contemporary systems operate effectively, the continuous use of such mechanisms may be physically demanding upon the operator, due to the need to exert continual force upon the handle as the product is compressed between the upper and lower platens. For example, when a dough product is being compressed the physical characteristics of the dough are such that flattening takes place slowly as the compression force is maintained. As an operator maintains the compressive force on the dough the platens slowly move together as the dough spreads outward.

As many companies realize, redundant physical stress upon the operator may give rise to safety concerns, as well as raise quality control issues respecting the consistency of the resultant product. While automatic presses are available that do not require manual pressing, such devices are typically expensive to purchase and operate, and do not provide the regulation available from manual presses. Moreover, such automatic devices may give rise to safety concerns inherent in the operation of automatic machinery.

Accordingly, there is a need to provide a manually operated press mechanism that mitigates or eliminates the requirement to manually maintain a compressive force upon the handle mechanism as the product is compressed between the upper and lower platens.

More particularly, in order to avoid operator stress it is therefore desirable to provide a press machine wherein the compressive force may be initially applied manually by the operator though mechanically maintained by the press mechanism independent of operator effort. It is further desirable to allow for a variation of the force level that is maintained by the mechanism after the operator applies the initial force and releases the handle mechanism.

Yet another short-coming of existing press machines concerns difficulties that may arise in releasing the platens from compression. When compressed, certain products, such as dough, create suction which holds the platens together and opposes efforts to release the platens from the compressed position. Consequently, the operator of contemporary dough presses may not only be strained by the need to manually maintain downward pressure upon the dough as it is formed, but may be additionally strained by the need to apply considerable upward force to overcome the suction caused by pressing operation as the platens are separated from one another. Accordingly, it would be desirable to additionally provide a means for mitigating the operator effort necessary to separate the platens after the product is compressed. Preferably, such means would be adjustable to settings appropriate for the product being compressed and would not interfere in the press operation when products are compressed.

These and other objects and advantages are addressed by the present invention as described in connection with the illustrated embodiments. It is to be understood, however, that the foregoing description and accompanying illustrations are intended as exemplary of various implementations of the present invention and are not limiting in relation alternate implementations consistent with the broader aspects of the invention.

BRIEF SUMMARY OF THE INVENTION

A pressing device is disclosed including a housing, a lower engaged to that housing and adapted to receive products to be pressed and an upper platen engaged to the housing and manually translatable with respect to the lower platen. A handle mechanism is connected to the upper platen for translating the upper platen with respect to the lower platen. The handle mechanism includes a resilient over-center locking mechanism for translating the upper platen to a locked position proximate the lower platen, whereupon the upper platen is further translated towards the lower platen independent of manual force.

In the presently preferred embodiment the pressing device includes at least one resilient compression member connected to the over-center locking mechanism an operative to urge towards the lower platen at a substantially constant compressive force. The resilient compression member may be comprised as a pair of springs.

The handle mechanism may further comprise an adjustment mechanism, connected to the resilient compression member, for adjusting the operating length of the resilient compression member. The adjustment mechanism may include a stop bar, in abutting engagement with the compression member and translatable within the handle mechanism, to adjust pre-load of the compression member.

At least one resilient mounting member may be provided to connect the lower platen to the housing. The resilient mounting member is deformable to allow the lower platen to translate to a slanted position relative to the upper platen, as the upper platen is moved upwardly therefrom. This relieves suction formed by compression of products between the upper and lower platens, facilitating separation of the platens.

A resilient base securant member may be disposed on the lower surface of the housing to engage a support surface, and to maintain the contacting engagement between the housing and the support surface during separation of the platens.

BRIEF DESCRIPTION OF THE DRAWINGS

These as well as other features of the present invention will become more apparent upon reference to the drawings wherein.

DETAILED DESCRIPTION OF THE INVENTION

The description below sets for the structure and operation of the invention, in conjunction with the illustrated embodiments. However, as will be recognized by those skilled in the art, the present invention may be implemented in alternate forms and embodiments that also embody the broader structural and functional aspects of the invention.

In general terms, the invention provides a mechanism for maintaining a consistent compressive force upon an object being pressed, after the platens are manually urged to a compressive condition. An over center locking mechanism may be utilized to facilitate moving the mechanism to a position wherein the product is compressed, after which the level of compression is maintained without further operator effort. The level of force maintained by the mechanism may be varied in accordance with the requirements of a particular application.

Further in accordance with the invention at least a portion of the lower platen is resiliently engaged to the press housing to allow the lower platen to angle slightly as the upper platen is elevated from the compressed position. The resulting angle of the lower platen mitigates sealing engagement of the platens caused by compression of the product, i.e. the upper platen may be peeled away from engagement to the lower platen to overcome suction.

In accordance with another illustrated embodiment, a suction cup or other resilient member may be provided on the lower surface of the press housing to create a suction to maintain the press housing in contact with the supporting surface as the platens are separated from the compressed position. The resilient member formed on the lower surface of the housing therefore facilitates separation of the platens as the housing maintains secure working contact with the supporting surface.

Figure 2:
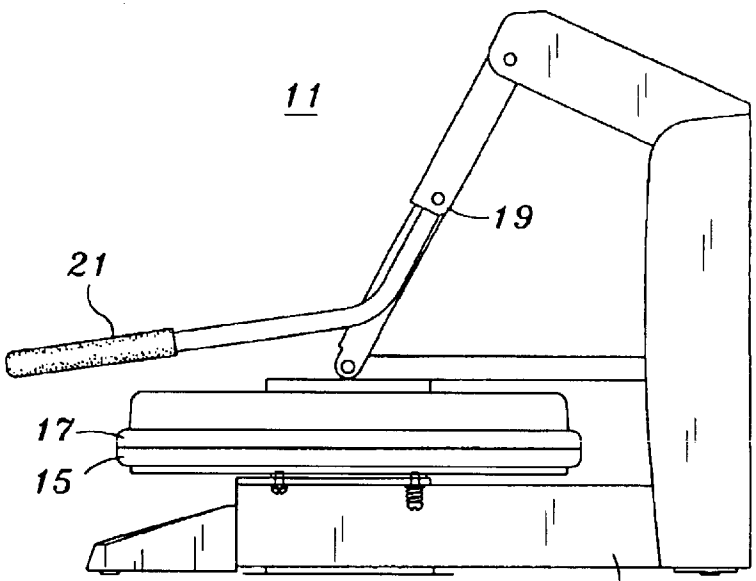
FIG. 2 shows the illustrated embodiment in a closed position.
Figure 1:
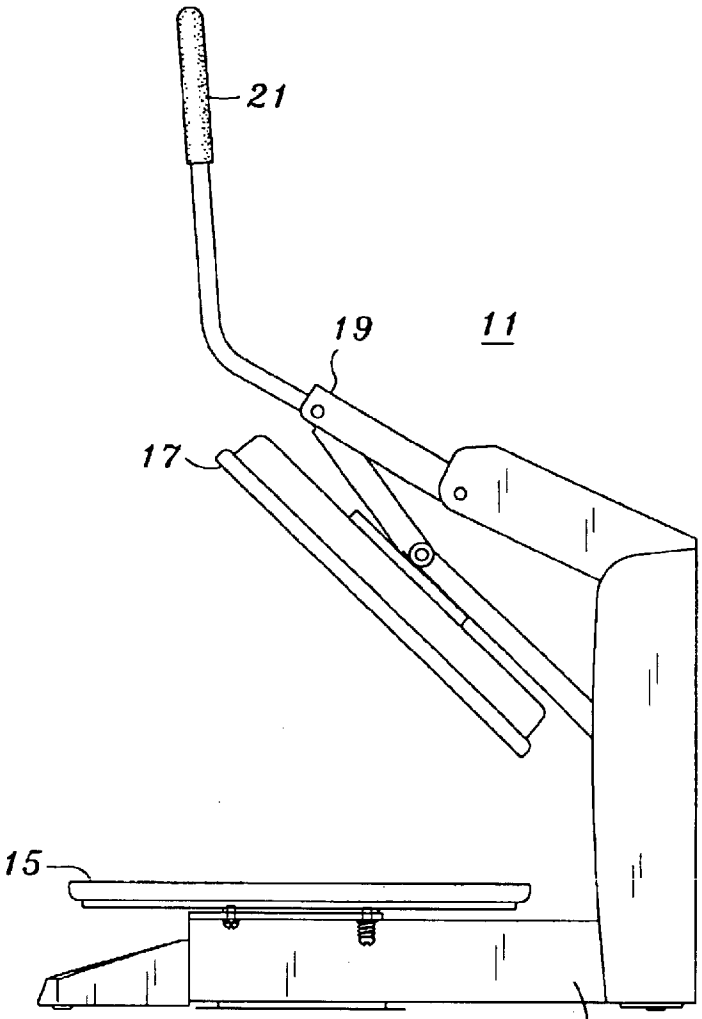
FIG. 1 is an illustration of one embodiment of the invention, shown in an open position.

Turning to the drawings, FIG. 1 is a front view of a press mechanism in accordance with the present invention. The press mechanism 11 includes a housing 13, lower platen 15 and upper platens 17. Handle mechanism 19 is connected to the upper platen 17 and functions to translate the upper platen from an open position, as shown in FIG. 1, to a closed position as shown in FIG. 2. As set forth in more detail below, handle mechanism 19 includes an over-center locking mechanism such that downward movement of handle 21 translates the upper platen 17 to a locked position, whereupon the handle 21 may be released while the upper platen 17 continues to be urged towards lower platen 15. The operation of the over-center locking mechanism shown in more detail in connection with FIGS. 3 and 4.

Typically an over-center mechanism has a very small operating range, beyond which either there is not enough travel to lock the linkage or it becomes impossible to apply enough force to bring the linkage over-center. This operating range is usually adjustable by means of a screw, etc. although this adjusts the operating position not the range of adjustment.

This arrangement is suitable for clamping operations or for transfer printing where the objects under pressure are non-compressible. However, for an elastic substance, like pizza dough for instance it is not possible to bring the operating lever to over-center position until the dough is pressed to almost the finished thickness, which would mean the operator has to apply considerable force to the handle for an extended period of time.

To overcome this problem a pair of heavy-duty springs are used in the present invention, which are compressed as the handle is brought over-center, before the pizza dough reaches the finished thickness. The springs are mounted together in a movable adjustment mechanism, acted on by a threaded knob. Moving the spring assembly alters the length of the linkage, thereby changing the preload on the spring.

As the dough is acted upon by the upper platen the force supplied by the springs spreads the dough out, the surface area increasing as the square of the diameter. The force supplied by the spring decreases linearly, so the 'elastic' force of the dough and the opposing spring force tend towards equilibrium, which sets the thickness of the pizza crust. The actual setting for the spring pre-load may be arrived at by trial and error, and is then repeatable by referring to markings on the adjustment mechanism. A built-in timer may be provided to let the operator know when to release the upper platen.

Figure 3B:
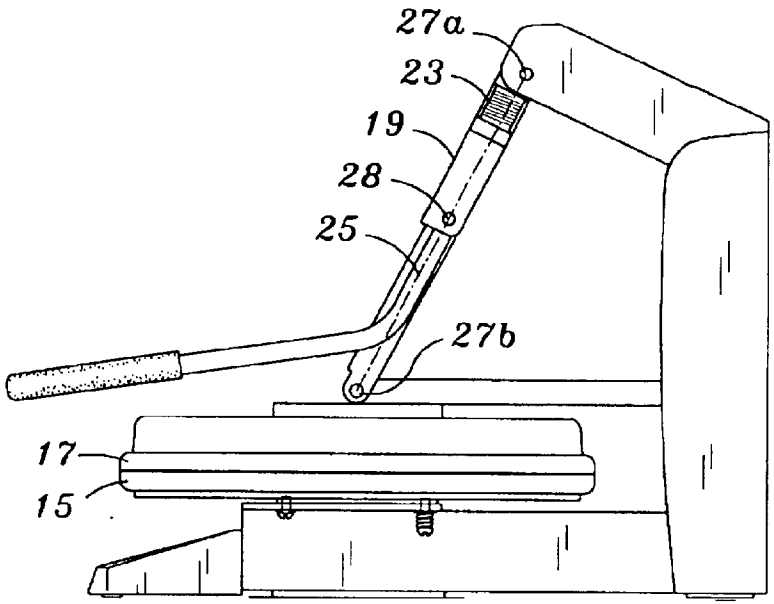
FIG. 3 illustrates the over-center locking mechanism of the invention.
Figure 3A:
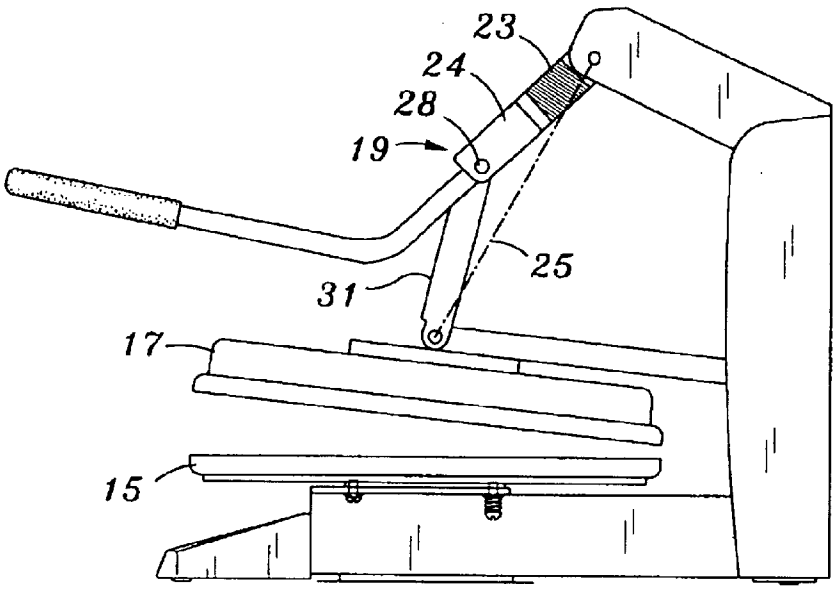

Referring to FIGS. 3*a*, 3*b*, the operation of the over-center locking mechanism is illustrated. FIG. 3*a* illustrates the over-center locking mechanism as moved towards a closed position. Prior to reaching a closed position the compression spring 23 is at its initial preset operating length. Upon reaching the closed position, as illustrated in FIG. 3*b*, the compression spring 23 is compressed by movement of the handle mechanism 19, the result of which is to urge the upper platen 17 towards lower platen 15, thereby compressing any product there-between at a constant force until the spring extends to its operating length or until the platens meet.

Figure 4:
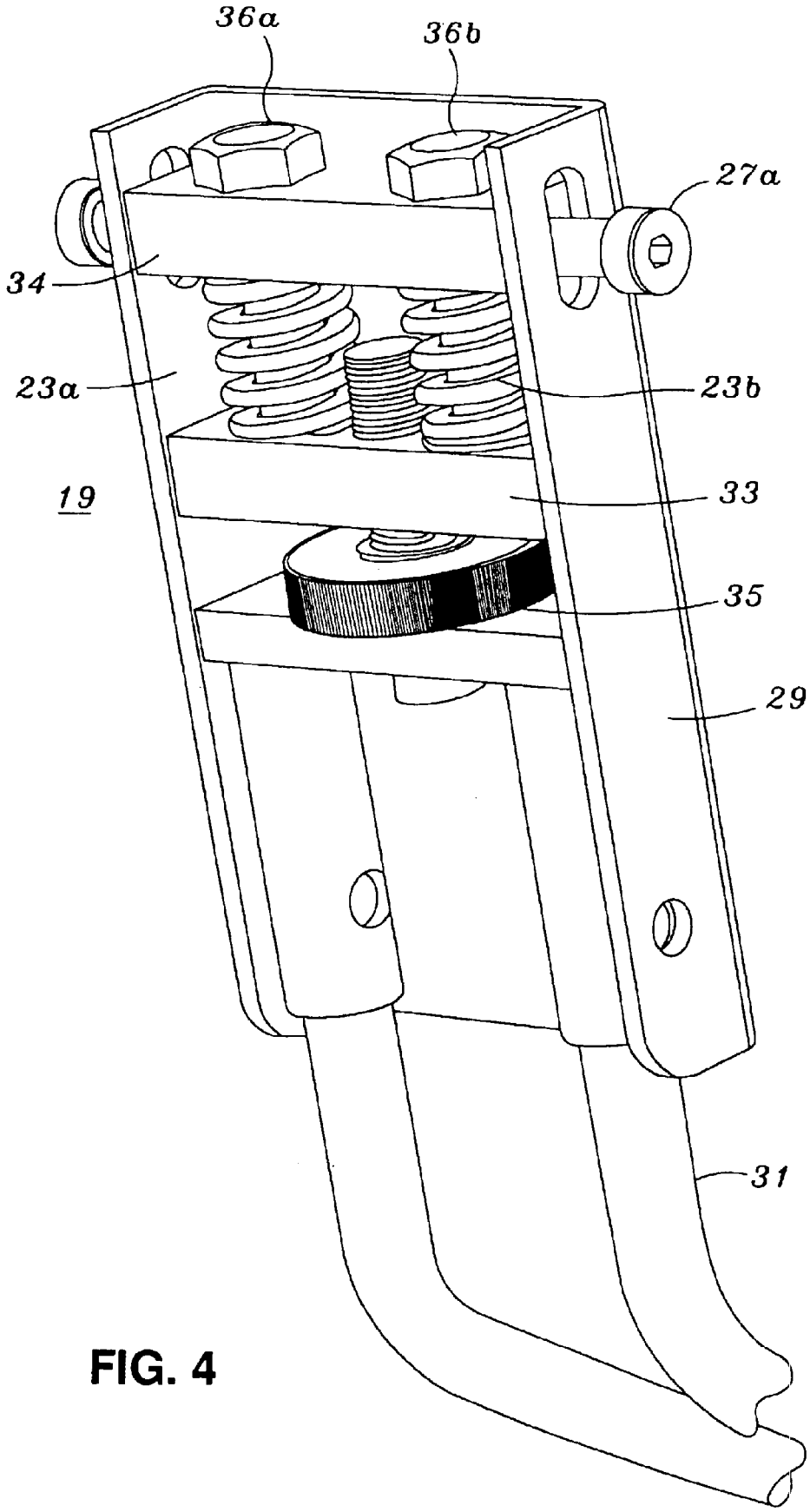
FIG. 4 is an enlarged view showing the mechanism for adjusting the position of the stop bar to regulate preload of the compression spring.

FIGS. 3*a*, 3*b*, illustrate pivot line 25 which extends between pivoting connectors 27*a*, 27*b* of the handle mechanism. As shown at FIG. 3*b*, pivoting connector 28, which connects upper and lower portions of the handle mechanism, 29,31 respectively, is translatable to a position behind pivot line 25, to maintain the handle mechanism in a locked position after it is manually translated to that position. The handle mechanism may then be released while the upper platen is urged further downwardly by the operation of compression member 23. FIG. 4 provides further detail of the handle mechanism 19. As shown therein, the compression member 23 may be formed as a pair of heavy duty springs 23*a*, 23*b*. The springs are secured to the handle mechanism upper portion 29 by abutting engagement to stop bar 34 and bolts 36*a*, 36*b*.

The compression springs 23*a*, 23*b* also abut against moveable stop bar 33, which translates in response to rotation of adjustment mechanism 35. By rotating adjustment mechanism 35, the position of the stop bar 33 translates to adjust preload applied to compression springs 23*a*, 23*b*. The compression springs 23*a*, 23*b* are further loaded as the handle mechanism is translated to the locked position. Thereafter, the compression springs 23*a*, 23*b* urge the downward translation of the handle mechanism lower portion 31, which in turn applies the compressive force of the compression springs to upper platen 17, thereby compressing products disposed between the upper and lower platens.

Figures 5, 6, 7:
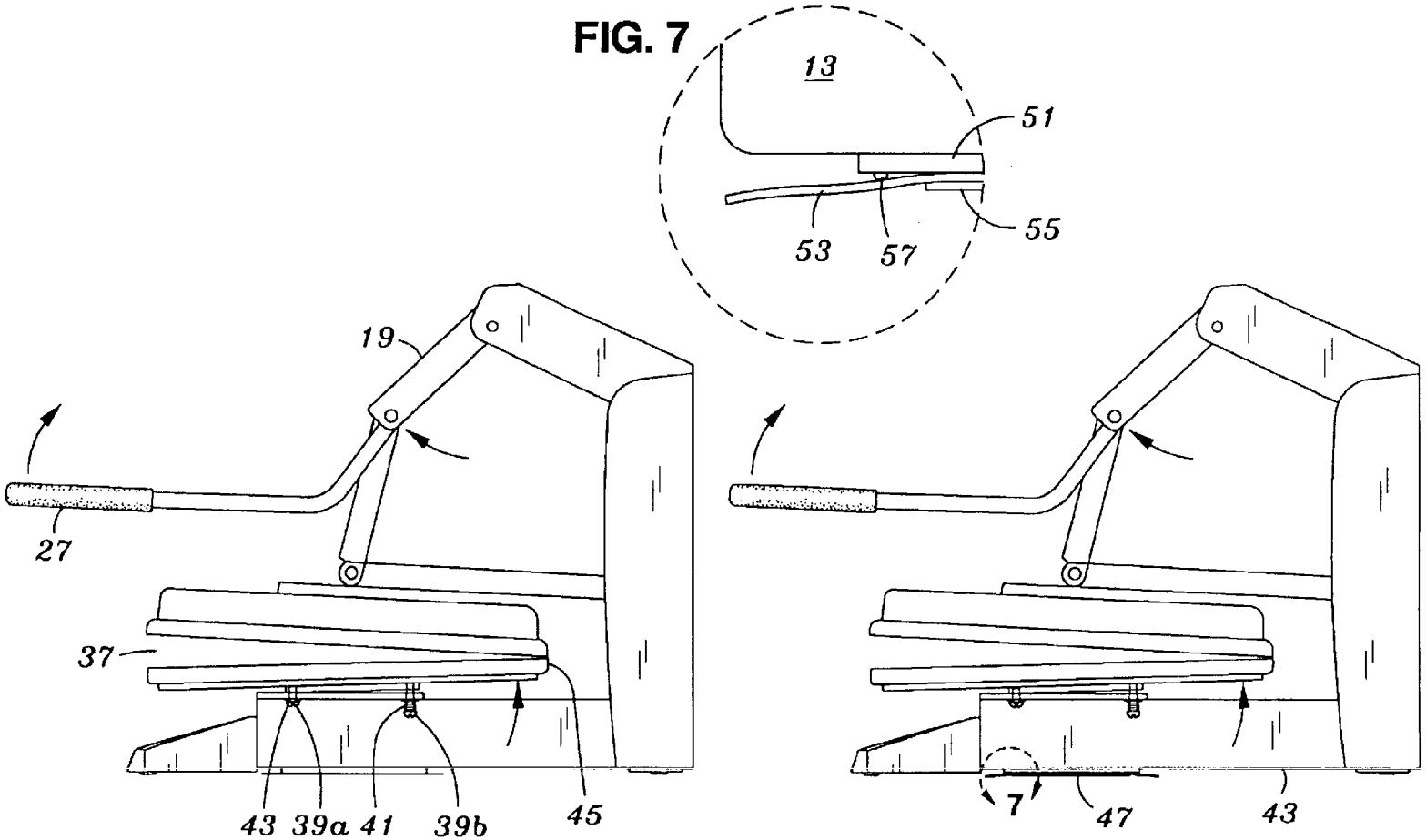
FIG. 5 is an illustration of the resilient mounting member (s) for engaging the lower platen to the housing.
FIG. 6 is an illustration of the resilient base securement member for securing the housing to the support surface.
FIG. 7 is an enlarged view of the base securement member shown at FIG. 6.

FIG. 5 further illustrates operation of the pressing device during upward translation of the upper platen. As shown therein, upward movement of the handle 21 releases the handle mechanism from a locked position allowing the upper platen to be separated from the lower platen. However, as described above, upward translation of the upper platen may be opposed by suction created drawing compression of products during the compression operation. To relieve the suction, the pressing mechanism is provided with apparatus allowing the lower platen to slant as the upward upper platen is translated upwardly, thereby cracking a vacuum at the front joint 37 of the upper and lower platens, thereby relieving suction formed by compression of products between the upper and lower platens, facilitating separation of the upper and lower platens.

As shown in FIG. 5, lower platen 15 is secured to housing 13, by means of engagement members 39*a*, 39*b*. Engagement member 39*b* is provided with a resilient member, such as spring 41. Engagement member 39*a* is provided with a resilient spring washer 43. The spring 41 allows rear portion 45 of the lower platen to move upwardly towards the upper platen, as the upper platen is translated away from the lower platen. Spring washer 43 facilitates pivoting of the lower platen about engagement member 39*s* as the rear portion 45 of the lower platen moves upwardly.

Accordingly, while the lower platen remains flat against the housing during compression, the lower platen is resiliently engageable to the housing, to allow the rear portion of the lower platen to pivot upwardly as the compression pressure is relieved, facilitating separation of the upper and lower platens.

As shown in FIG. 6, the pressing device may further be provided with a resilient base securement member 47 which operates to maintain the housing 13 in engagement with support surface 49 during upward translation of the upper platen. Further detail of the presently preferred embodiment of the base securement member is shown in FIG. 7. As illustrated therein, the base securement member 47 includes a mounting plate 51 in abutting engagement with the housing 13. A rubber seal 53 is provided and secured to the mounting plate 51 by a backing plate 55. An O ring 57 extends proximate the periphery of mounting plate 51, spacing rubber seal 53 therefrom.

The base securement member 47 operates to form a vacuum seal, engaging the housing 13 to the support surface 49, thereby opposing displacement of the housing from the support surface as the handle mechanism is translated upwardly. The resilient base securement member 47 thereby holds the housing in place on the support surface to facilitate pivoting of the lower platen to crack the vacuum between the upper and lower platens. As noted above, the embodiments described and illustrated herein are intended to be exemplary of the present invention and not limiting in relation to alternate embodiments that perform the same or equivalent functions. For example, as will be apparent to one of ordinary skill in the art, a handle mechanism may be constructed in an alternate manner while providing the same functionality as described herein. Similarly, mechanisms for releasing the platens from suction engagement or holding the housing in contact with the support surface may be modified without departing from the functions or advantages thereof.

What is claimed is:

1. A pressing device for manually compressing products comprising:

a) a housing;

b) a lower platen engaged to the housing and adapted to receive products to be pressed;

c) an upper platen engaged to the housing and manually translatable with respect to the lower platen;

d) a handle mechanism connected to the upper platen for translating the upper platen with respect to the lower platen, the handle mechanism including a resilient over-center locking mechanism for translating the upper platen to a locked position proximate the lower platen, whereupon the upper platen is further translated toward the lower platen, independent of manual force;

e) the handle mechanism further comprising at least one resilient compression member connected to the over-center locking mechanism, the resilient compression member being operative to urge the upper platen towards the lower platen at a substantially constant compressive force; and f) an adjustment mechanism, connected to the resilient compression member, for adjusting the operating length of the resilient compression member.

2. The device as recited in claim 1 wherein the resilient compression member comprises a pair of springs.

3. The device as recited in claim 1 wherein the adjustment mechanism comprises a stop bar, in abutting engagement with the compression member and translatable within the handle mechanism, to adjust preload of the compression member.

4. The device as recited in claim 1 further including at least one resilient mounting member connecting the lower platen to the housing, the resilient mounting member being deformable to allow the lower platen to translate to a slanted position relative to the upper platen as the upper platen is translated upwardly therefrom.

5. The device as recited in claim 1, further comprising a resilient base securement member disposed on a lower surface of the housing, the base securement member being operative to maintain the housing in contact engagement with a support surface during upward translation of the upper platen.

6. A pressing device for manually compressing products comprising:

a) a housing;

b) a lower platen engaged to the housing and adapted to receive products to be pressed;

c) an upper platen engaged to the housing and manually translatable with respect to the lower platen;

d) a handle mechanism connected to the upper platen for translating the upper platen with respect to the lower platen, the handle mechanism including a resilient over-center locking mechanism for translating the upper platen to a locked position proximate the lower platen, whereupon the upper platen is further translated toward the lower platen, independent of manual force; and e) the handle mechanism further comprising at least one resilient compression member connected to the over-center locking mechanism, the resilient compression member being operative to urge the upper platen towards the lower platen at a substantially constant compressive force and being deformable to allow the lower platen to translate to a slanted position relative to the upper platen as the upper platen is translated upwardly therefrom.

7. The device as recited in claim 6 wherein the resilient compression member comprises a pair of springs.

8. The device as recited in claim 6 wherein the handle mechanism further comprises an adjustment mechanism, connected to the resilient compression member, for adjusting the operating length of the resilient compression member.

9. The device as recited in claim 8 wherein the adjustment mechanism comprises a stop bar, in abutting engagement with the compression member and translatable within the handle mechanism, to adjust preload of the compression member.

10. The device as recited in claim 6, further comprising a resilient base securement member surface of the housing, the base securement member being operative to maintain the housing in contact engagement with a support surface during upward translation of the upper platen.

* * * * *